US010563383B2

(12) United States Patent
Lu et al.

(10) Patent No.: US 10,563,383 B2
(45) Date of Patent: Feb. 18, 2020

(54) FAUCET MOUNTING STRUCTURE

(71) Applicant: XIAMEN EASO CO., LTD., Xiamen, Fujian (CN)

(72) Inventors: Haitao Lu, Xiamen (CN); Zhen Li, Xiamen (CN); Yuebin Yang, Xiamen (CN); Ximin Chen, Xiamen (CN)

(73) Assignee: XIAMEN EASO CO., LTD., Xiamen, Fujian (CN)

( * ) Notice: Subject to any disclaimer, the term of this patent is extended or adjusted under 35 U.S.C. 154(b) by 3 days.

(21) Appl. No.: 16/004,453

(22) Filed: Jun. 11, 2018

(65) Prior Publication Data

US 2019/0376264 A1 Dec. 12, 2019

(51) Int. Cl.
*E03C 1/04* (2006.01)

(52) U.S. Cl.
CPC ..... *E03C 1/0401* (2013.01)

(58) Field of Classification Search
CPC ..... E03C 1/04; E03C 1/0401; E03C 1/0402
See application file for complete search history.

(56) References Cited

U.S. PATENT DOCUMENTS 8,231,318 B2 * 7/2012 Pitsch ..... F16B 37/0864 411/270
9,222,245 B2 * 12/2015 Ye ..... E03C 1/0401
9,637,893 B2 * 5/2017 Lin ..... E03C 1/0401
2013/0220439 A1 * 8/2013 Pitsch ..... E03C 1/0401 137/15.08

* cited by examiner

*Primary Examiner* — Kevin F Murphy
(74) *Attorney, Agent, or Firm* — Chun-Ming Shih

(57) ABSTRACT

A faucet mounting structure includes a pipe connector and a fixing assembly in cooperation with the pipe connector. The fixing assembly includes an upper main body and a lower main body. A first inclined surface of the upper main body and a second inclined surfaces of the lower main body are pressed against each other or separated from each other, so that a press ring of the lower main body is compressed or returned for engaging with or disengaging from an external thread of the pipe connector to realize the quick assembly and disassembly of the pipe connector and the fixing assembly, and the quick assembly and disassembly of the faucet body is realized.

6 Claims, 5 Drawing Sheets

FAUCET MOUNTING STRUCTURE

BACKGROUND OF THE INVENTION

1. Field of the Invention

The present invention relates to a faucet mounting structure, and more particularly to a faucet mounting structure which can be installed easily.

2. Description of the Prior Art

In general, a bathroom faucet is installed close to the wall. Due to the shape of the basin, the space under the countertop for locking the faucet is limited. Most faucets are threadedly connected to basins. According to the traditional operation to lock a nut on a screw rod, the nut is rotated from the lower end of the screw rod. The effective length of the screw rod depends on the thickness of the countertop, which determines the length of the nut to be locked. The space under the countertop is quite narrow, and the operation space is extremely limited. Thus, to lock or unlock the nut takes time and energy. The installation efficiency is low. It is difficult to align the starting point of the screw thread.

Accordingly, the inventor of the present invention has devoted himself based on his many years of practical experiences to solve these problems.

SUMMARY OF THE INVENTION

The primary object of the present invention is to provide a faucet mounting structure, which is simple in structure and can be assembled and disassembled quickly and easily.

In order to achieve the aforesaid object, the faucet mounting structure of the present invention comprises a pipe connector and a fixing assembly. A lower portion of the pipe connector has an external thread. The fixing assembly includes an upper main body and a lower main body which are arranged from top to bottom. The upper main body has a central through hole through which the external thread of the pipe connector passes. A bottom surface of the upper main body is provided with a guide post corresponding to an outer periphery of the through hole. The guide post has a first inclined surface that is gradually enlarged outward and downward from one side of the through hole. The lower main body has another central through hole through which the external thread of the pipe connector passes. The lower main body includes a press ring around an inner side thereof. The press ring is formed with at least one opening. An inner peripheral wall of the press ring, facing the through hole of the lower main body, is provided with an internal thread to cooperate with the external thread of the pipe connector. A top end of an outer peripheral wall of the press ring is provided with a second inclined surface that is tapered upward. The lower main body is provided with an accommodating groove around an outer periphery of the press ring for accommodating the guide post of the upper main body.

Preferably, the bottom surface of the upper main body is provided with at least one limiting rib. The limiting rib is disposed on an outer periphery of the guide post. The accommodating groove of the lower main body is provided with a limiting groove corresponding to the limiting rib of the upper main body.

Preferably, the upper main body is provided with at least one elastic post extending downward. A top end of the lower main body has a guide hole for the elastic post to be inserted therein.

Preferably, the elastic post includes two spaced protruding posts. A gap is formed between the two protruding posts. Each protruding post has an inner surface that faces the gap and is a flat surface and an outer peripheral surface that is an inclined curved surface and is gradually enlarged from top to bottom, so that the elastic post is an elastic structure that is gradually enlarged from top to bottom.

Preferably, the press ring of the lower main body is formed with a plurality of openings to divide the press ring into a plurality of press blocks.

Preferably, the lower main body further includes a lower casing spaced from the press ring. The lower casing is spaced a predetermined distance from the outer periphery of the press ring. A lower portion of the lower casing is integrally formed with a lower portion of the press ring so that the accommodating groove is formed between the lower casing and the press ring.

Preferably, a top surface of the upper main body is formed with a retaining ring. Top ends of the limiting rib and the guide post are disposed on a bottom surface of the retaining ring.

Preferably, the limiting rib has a height greater than that of the guide post.

Accordingly, the present invention achieves the rapid assembly and fixation of the fixing assembly and the pipe connector through the cooperation of the upper main body and the lower main body. The first inclined surface of the upper main body and the second inclined surfaces of the lower main body are pressed against each other or separated from each other, so that the press ring of the lower main body is compressed or returned for engaging with or disengaging from the external thread of the pipe connector to realize the quick assembly and disassembly of the pipe connector and the fixing assembly, and the quick assembly and disassembly of the faucet body is realized.

DETAILED DESCRIPTION OF THE PREFERRED EMBODIMENTS

Figure 1:
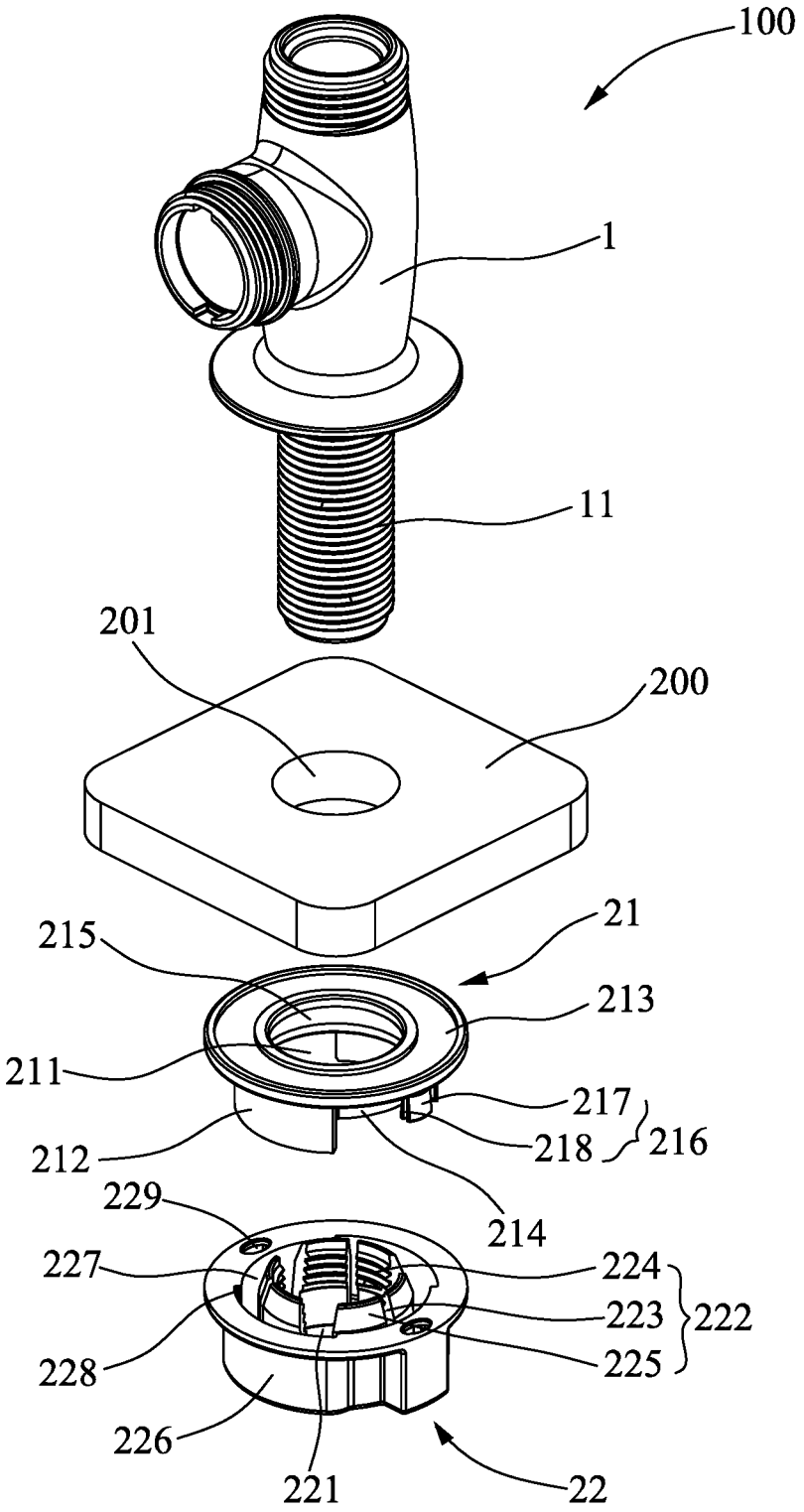
FIG. 1 is an exploded view of the present invention.

Embodiments of the present invention will now be described, by way of example only, with reference to the accompanying drawings.

As shown in FIG. 1 to FIG. 9, the present invention discloses a faucet mounting structure 100. The faucet mounting structure 100 comprises a pipe connector 1 and a fixing assembly 2.

The upper portion of the pipe connector 1 is mounted on a countertop 200 and cooperates with a faucet body (not shown in the figures). The countertop 200 has amounting hole 201. The lower portion of the pipe connector 1 has an external thread 11. The lower portion of the pipe connector 1 passes through the mounting hole 201 of the countertop 200 to cooperate with the fixing assembly 2.

The fixing assembly 2 includes an upper main body 21 and a lower main body 22 which are arranged from top to bottom.

The upper main body 21 has a central through hole 211 through which the external thread 11 of the pipe connector 1 passes. The bottom of the upper main body 21 is provided with at least one limiting rib 212. The top surface of the upper main body 21 is formed with a retaining ring 213. The upper main body 21 is provided with a guide post 214 on the bottom surface of the retaining ring 213 corresponding to the outer periphery of the through hole 211. The guide post 214 has a first inclined surface 215 that is gradually enlarged outward and downward from one side of the through hole 311. The limiting rib 212 is disposed on the outer periphery of the guide post 214. The top end of the limiting rib 212 is disposed on the bottom surface of the retaining ring 213. The height of the limiting rib 212 is greater than the height of the guide post 214 so that the limiting rib 212 extends beyond the guide post 214. The retaining ring 213 is further provided with at least one elastic post 216. Preferably, the retaining ring 213 is provided with two or more than two elastic posts 216. The elastic posts 216 are arranged at equal intervals. In this embodiment, the retaining ring 213 is provided with two elastic posts 216. Each elastic post 216 includes two spaced protruding posts 217. A gap 218 is formed between the two protruding posts 217. Each protruding post 217 has an inner surface that faces the gap 218 and is a flat surface and an outer peripheral surface that is an inclined curved surface and is gradually enlarged downward from the retaining ring 213, so that the elastic post 216 is an elastic structure that is gradually enlarged from top to bottom.

Figure 2:
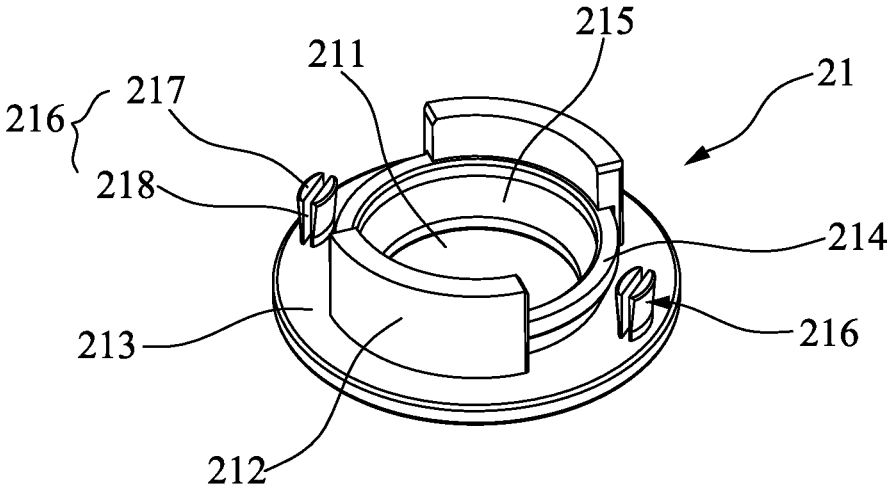
FIG. 2 is a bottom perspective view of the upper main body of the present invention.
Figure 3:
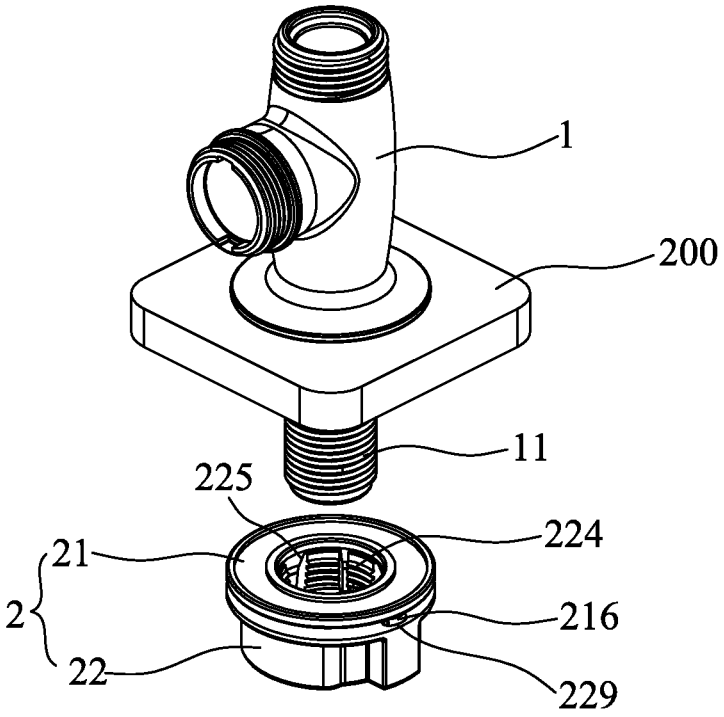
FIG. 3 is a first schematic view showing the installation of the present invention.
Figure 4:
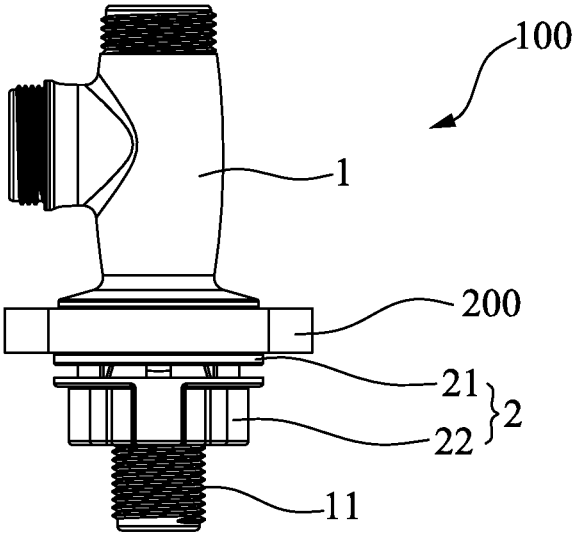
FIG. 4 is a second schematic view showing the installation of the present invention.
Figure 5:
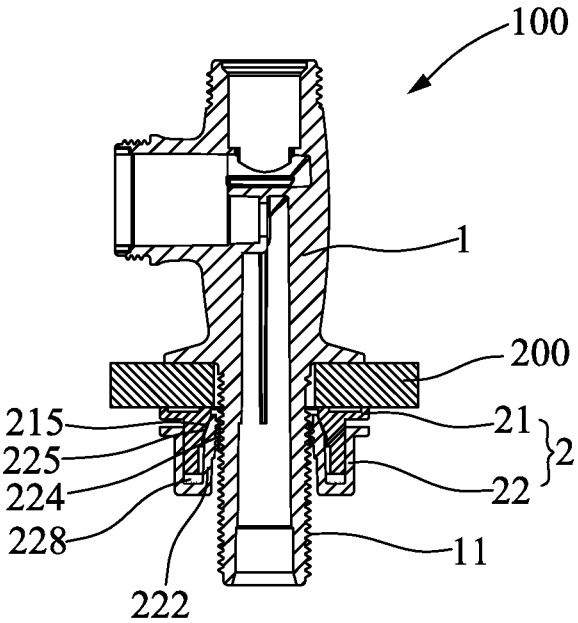
FIG. 5 is a sectional view of FIG. 4.
Figure 6:
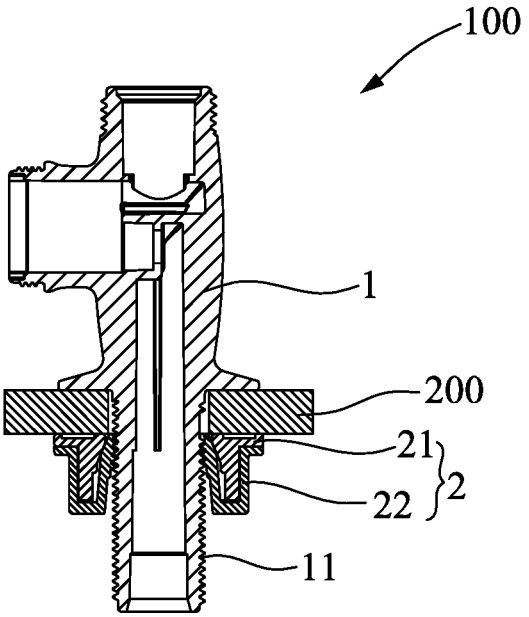
FIG. 6 is a sectional view after the present invention is installed.
Figure 7:
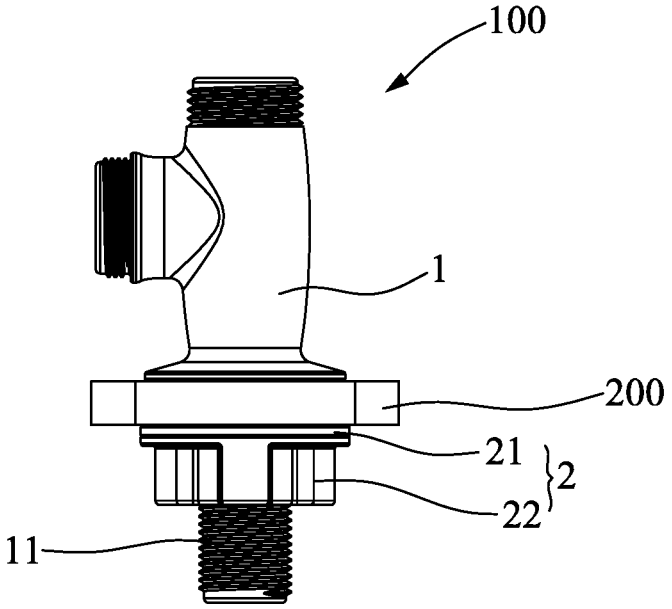
FIG. 7 is a schematic view after the present invention is installed.
Figure 8:
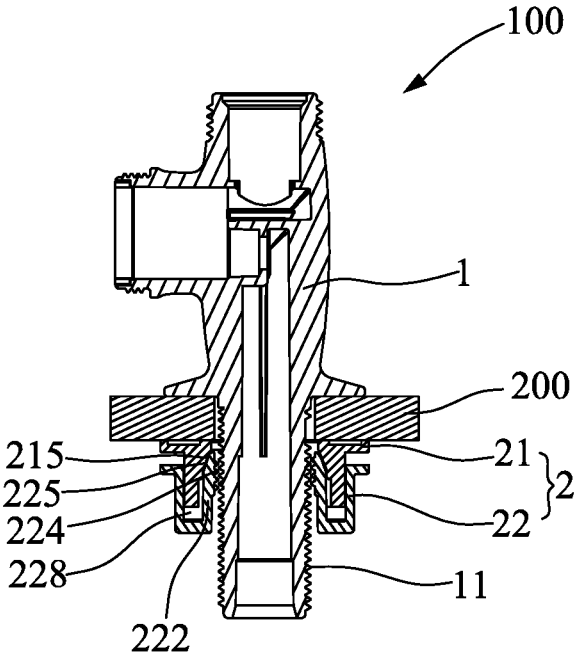
FIG. 8 is a sectional view showing the detachment of the present invention.
Figure 9:
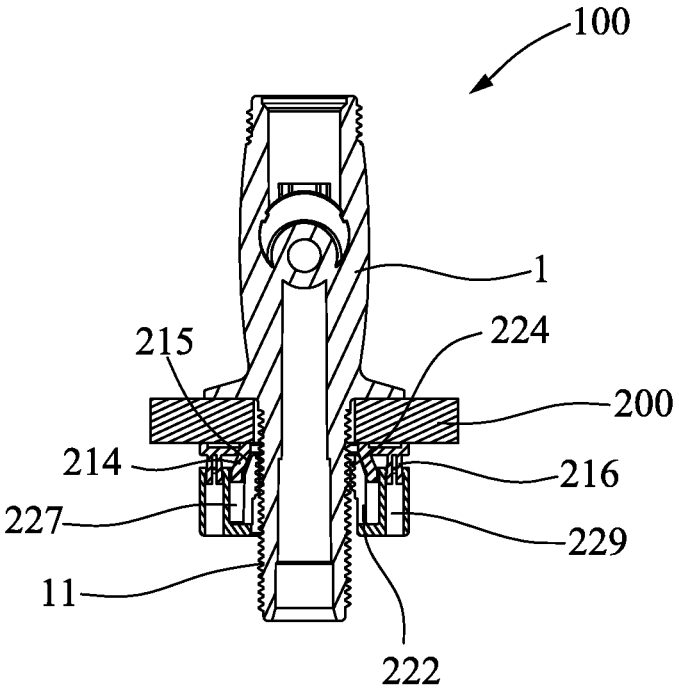
FIG. 9 is another sectional view showing the detachment of the present invention.

The lower main body 22 also has a central through hole 221 through which the lower portion having the external thread 11 of the pipe connector 1 passes. The lower main body 22 includes a press ring 222 around an inner side thereof. The press ring 222 is formed with at least one opening 223. As shown in FIG. 1 and FIG. 2, in the embodiment, the press ring 222 is formed with a plurality of openings 223 to divide the press ring 222 into a plurality of press blocks, so that the press ring 222 may be elastically deformed after being applied with a force. The inner peripheral wall of the press ring 222, facing the through hole 221 of the lower main body 22, is provided with an internal thread 224 to cooperate with the external thread 11 of the pipe connector 1. The top end of the outer peripheral wall of the press ring 222 is provided with a second inclined surface 225 that is tapered upward. The lower main body 22 further includes a lower casing 226 spaced from the press ring 222. The lower casing 226 is spaced a predetermined distance from the outer periphery of the press ring 222. The lower portion of the lower casing 226 is integrally formed with the lower portion of the press ring 222 so that an accommodating groove 227 is formed between the lower casing 226 and the press ring 222. The accommodating groove 227 is provided with a limiting groove 228 corresponding to the limiting rib 212 of the upper main body 21. The top end of the lower main body 22 has a guide hole 229 for the elastic post 216 to be inserted therein.

When the fixing assembly 2 is assembled, the elastic post 216 of the upper main body 21 is pressed and inserted into the guide hole 229 of the lower main body 22, and the limiting rib 212 of the upper main body 21 is correspondingly inserted into the limiting groove 228 of the lower main body 22. The guide post 214 of the upper main body 21 is correspondingly fitted in the accommodating groove 227 of the lower main body 22. After the elastic post 216 is inserted into the guide hole 229, the upper main body 21 and the lower main body 22 won't be separated from each other. The upper main body 21 and the lower main body 22 are combined together to form the fixing assembly 2.

As shown in FIG. 3 to FIG. 7, when the present invention is assembled, the bottom end of the pipe connector 1 is inserted through the mounting hole 201 of the countertop 200, and the fixing assembly 2 after assembled is fitted on the pipe connector 1 from the bottom end of the pipe connector 1. The pipe connector 1 passes through the through holes of the upper main body 21 and the lower main body 22 in sequence, and then the fixing assembly 2 is pushed upward until the retaining ring 213 at the top of the upper main body 21 abuts against the underside of the countertop 200. When the top surface of the upper main body 21 abuts against the countertop 200, the lower main body 22 is further pushed upward. The first inclined surface 215 of the upper main body 21 is pressed against the second inclined surface 225 of the press ring 222 of the lower main body 22. When the second inclined surface 225 and the first inclined surface 215 are under compression, the press ring 222 will be compressed inward, and the internal thread 224 is meshed with the external thread 11 of the pipe connector 1. After the lower main body 22 is turned a circle, the press ring 222 is fully screwed to the pipe connector 1 to achieve a quick installation.

As shown in FIG. 6 to FIG. 9, when the present invention is detached, the fixing assembly 2 is rotated reversely to release the locking state of the press ring 222 and the pipe connector 1. The press ring 222 is returned outward to overcome the pressure of the first inclined surface 215 of the upper main body 21, so that the lower main body 22 will be released downward relative to the upper main body 21. Due to the arrangement of the elastic post 216 and the guide hole 229, the upper main body 21 and the lower main body 22 are not completely detached from each other. The internal thread 224 of the press ring 222 is disengaged from the external thread 11 of the pipe connector 1, and the fixing assembly 2 can be quickly removed to complete the detachment.

In summary, the present invention achieves the rapid assembly and fixation of the fixing assembly 2 and the pipe connector 1 through the cooperation of the upper main body 21 and the lower main body 22. The first inclined surface 215 of the upper main body 21 and the second inclined surfaces 225 of the lower main body 22 are pressed against each other or separated from each other, so that the press ring 222 of the lower main body 22 is compressed or returned for engaging with or disengaging from the external thread 11 of the pipe connector 1 to realize the quick assembly and disassembly of the pipe connector 1 and the fixing assembly 2, and the quick assembly and disassembly of the faucet body is realized.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A faucet mounting structure, comprising a pipe connector and a fixing assembly, a lower portion of the pipe connector having an external thread, characterized by:

the fixing assembly including an upper main body and a lower main body which are arranged from top to bottom, the upper main body having a central through hole through which the external thread of the pipe connector passes, a bottom surface of the upper main body being provided with a guide post corresponding to an outer periphery of the through hole, the guide post having a first inclined surface that is gradually enlarged outward and downward from one side of the through hole; the lower main body having another central through hole through which the external thread of the pipe connector passes, the lower main body including a press ring around an inner side thereof, the press ring being formed with at least one opening, an inner peripheral wall of the press ring, facing the through hole of the lower main body, being provided with an internal thread to cooperate with the external thread of the pipe connector, a top end of an outer peripheral wall of the press ring being provided with a second inclined surface that is tapered upward, the lower main body being provided with an accommodating groove around an outer periphery of the press ring for accommodating the guide post of the upper main body;

wherein the upper main body is provided with at least one elastic post extending downward, a top end of the lower main body has a guide hole for the elastic post to be inserted therein;

wherein the elastic post includes two spaced protruding posts, a gap is formed between the two protruding posts, each protruding post has an inner surface that faces the pap and is a flat surface and an outer peripheral surface that is an inclined curved surface and is gradually enlarged from top to bottom, so that the elastic post is an elastic structure that is gradually enlarged from top to bottom.

2. The faucet mounting structure as claimed in claim 1, wherein the bottom surface of the upper main body is provided with at least one limiting rib, the limiting rib is disposed on an outer periphery of the guide post, and the accommodating groove of the lower main body is provided with a limiting groove corresponding to the limiting rib of the upper main body.

3. The faucet mounting structure as claimed in claim 2, wherein a top surface of the upper main body is formed with a retaining ring, and top ends of the limiting rib and the guide post are disposed on a bottom surface of the retaining ring.

4. The faucet mounting structure as claimed in claim 2, wherein the limiting rib has a height greater that that of the guide post.

5. The faucet mounting structure as claimed in claim 1, wherein the press ring of the lower main body is formed with a plurality of openings to divide the press ring into a plurality of press blocks.

6. The faucet mounting structure as claimed in claim 1, wherein the lower main body further includes a lower casing spaced from the press ring, the lower casing is spaced a predetermined distance from the outer periphery of the press ring, a lower portion of the lower casing is integrally formed with a lower portion of the press ring so that the accommodating groove is formed between the lower casing and the press ring.

* * * * *